United States Patent [19]

Raynor

[11] 4,175,715

[45] Nov. 27, 1979

[54] QUICK CHANGE SPINDLE MANDREL

[75] Inventor: Robert H. Raynor, Richmond, Va.

[73] Assignee: Philip Morris Incorporated, New York, N.Y.

[21] Appl. No.: 959,849

[22] Filed: Nov. 13, 1978

[51] Int. Cl.[2] ..... B65H 75/18; B65H 17/02

[52] U.S. Cl. ..... 242/72.1; 242/68.3

[58] Field of Search ..... 242/68.3, 72.1, 72 R, 242/78.3, 78.1; 279/2 R

[56] References Cited

U.S. PATENT DOCUMENTS

| | | | |
|---|---|---|---|
| 2,717,128 | 9/1955 | Heizer | 242/72.1 |
| 3,300,157 | 1/1967 | Koreishi | 242/78.1 |
| 4,079,896 | 3/1978 | Plach | 242/72.1 |
| 4,107,969 | 8/1978 | Okabe | 242/72.1 |

*Primary Examiner*—Edward J. McCarthy

*Attorney, Agent, or Firm*—Watson, Leavenworth, Kelton & Taggart

[57] ABSTRACT

An improved mandrel for use on a quick change spindle apparatus, the mandrel being a cylindrical sleeve having an external flange at one end, the sleeve having a plurality of axially directed slits intervening a like plurality of axially directed ribs, the ribs being connected at the ends thereof with adjacent ribs in alternating fashion so that the sleeve is rendered readily radially expandable for engaging and tightly holding a reel member.

5 Claims, 2 Drawing Figures

QUICK CHANGE SPINDLE MANDREL

BACKGROUND OF THE INVENTION

Various types of expandable chucks and/or devices of similar character are known for use in connection with the reception of a reel member upon which either a web of material already has been wound and is to be unwound therefrom or upon which the web of material is to be wound. In one class of such devices, an expandable member is used to engage the core or reel to thereby securely hold same while the winding or unwinding operation proceeds. Furthermore, means are provided for expanding and allowing contraction of the expandable member to mount and demount the core or reel. Such means can, for example, be a sliding wedge device, cam device or the like. Such devices, however, generally are of complicated construction, expensive to make from the standpoint of the machining and labor involved to produce same, and somewhat limited to the degree with which the expandable member can be expanded so as to serve for use with cores or reels over a range of inside diameters of the latter.

Representative of devices of the type with which the present invention is concerned, are those described in U.S. Pat. Nos. 441,476; 533,451; 967,334; 1,016,738; 2,352,580; 2,456,893; 2,717,128; 2,733,873; 2,941,745; 2,942,892; and 4,079,896.

SUMMARY OF THE PRESENT INVENTION

The present invention is concerned with spindle apparatus for mounting a reel for winding and unwinding of web material off and on the reel. Such spindle apparatus can include a shaft slidable along a fixed axis and to which is fixed a wedging core, the wedging core being concentric with the fixed axis and provided in a suitable configuration such as being a conical member. An expandable contractable mandrel encircles the core and provides the structure on which the reel is received with sliding of the shaft in one direction being effective to move the wedging core in contact with the internal surface of the mandrel for expanding same against a reel received on the mandrel. On the other hand, by sliding the shaft in an opposite direction the wedging core is moved out of contact with the mandrel and allows the same to contract. The present invention is particularly concerned with improvement in the mandrel structure as such.

The invention provides that the mandrel is a hollow cylindrical sleeve member having an external flange at one end. The sleeve is provided with a plurality of axially directed slits which extend along the sleeve body in circumferentially uniformly spaced relationship around the sleeve and adjacent slits in the sleeve extend from opposite tip ends of the sleeve in the direction of the other sleeve end and terminate closely adjacent to but spaced from the said other end of the sleeve. Moreover, it will be understood that the slits intervene a like plurality of ribs formed in the sleeve with the arrangement of slit disposition and extension from the opposite ends in the manner described being such that each rib has connecting structure at one end thereof integral with the succeeding next adjacent rib in the plurality and connecting structure at the other end thereof which is integral with the preceding next adjacent rib in the plurality. The mandrel sleeve thus is a contiguous structure of circumferentially spaced ribs, the ribs being joined at the ends thereof with adjacent ribs in alternating manner. The result is provision of a sleeve member which is most readily expandable to a considerable degree since the connecting structure at the ends of the ribs and the ribs themselves become in effect levers which can be bent in the circumferential direction to enhance the radial expansion of the overall sleeve structure.

The invention provides that the slits in the sleeve in a preferred form extend from one tip end thereof in the direction of the other tip end for a distance substantially 95% of the length of the sleeve. Furthermore, the internal surface of the sleeve is of tapered configuration and the external surface of the wedging core is complementally configured therewith, such internal surface taper desirably being inward toward the sleeve axis in the direction of the flange carrying end of the sleeve.

A further feature of the invention provides that a hub member is rotatably mounted on the shaft and the flange of the mandrel sleeve is received in an annular groove in the hub to thereby prevent axial movement of the sleeve relative to the shaft, such feature being particularly important to ensure that proper superposed winding of the web on the reel take place without any edge overlap as might occur if there were tolerance for axial movement of the mandrel sleeve.

The invention accordingly comprises the features of construction, combination of elements and arrangements of parts which will be exemplified in the construction hereinafter set forth and the scope of the invention will be indicated in the claims.

BRIEF DESCRIPTION OF THE DRAWING

Throughout the following description, like reference numerals are used to denote like parts of the drawing.

DESCRIPTION OF THE PREFERRED EMBODIMENTS

Figures 1, 2:
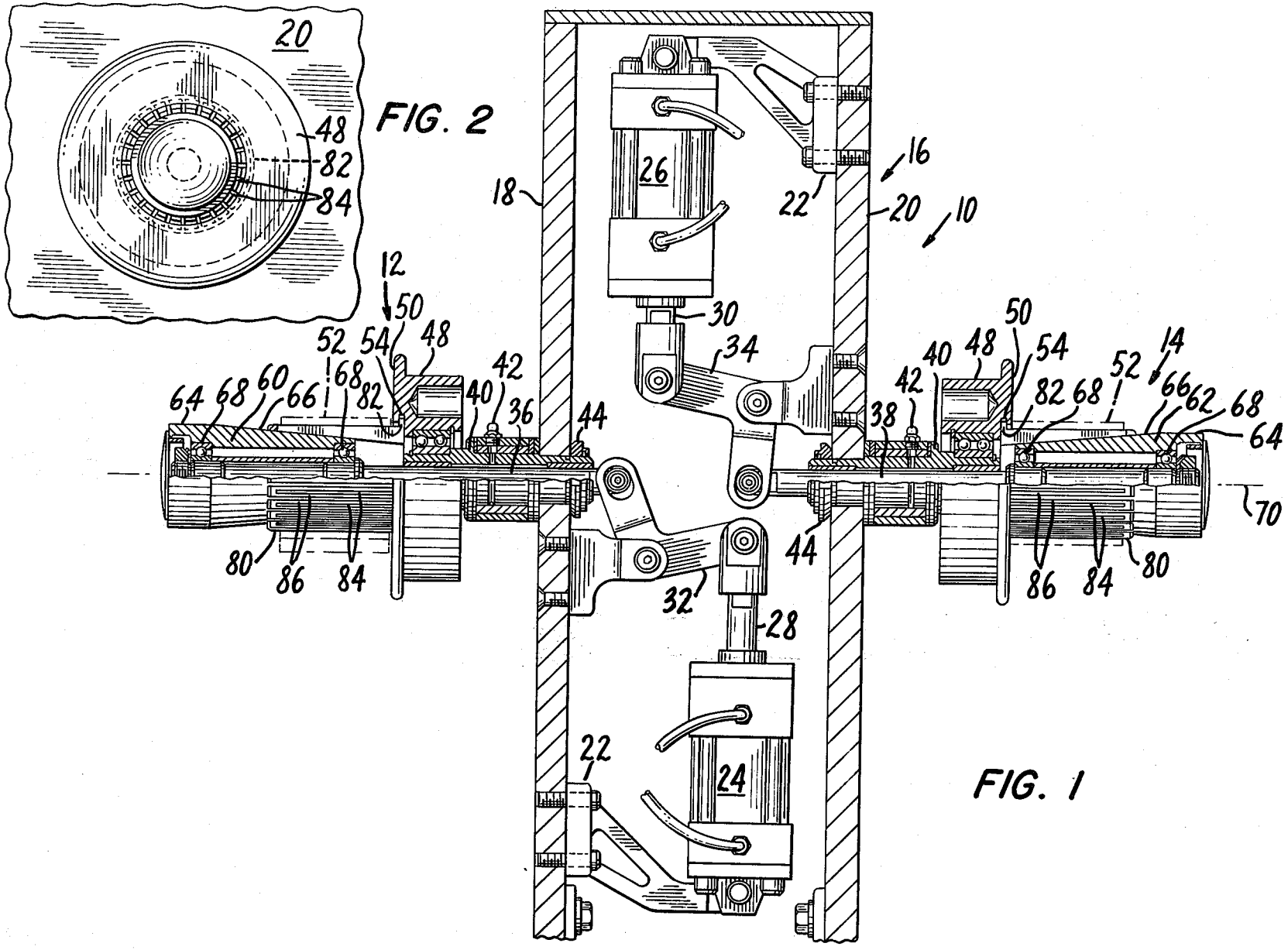
FIG. 1 is a plan view of a spindle apparatus embodying a mandrel made in accordance with the present invention, portions of the apparatus being shown in section and broken away for purposes of clarity, the apparatus depicted including power operated means by which the shaft carrying the core member can be slid along a fixed axis, the mandrel on the fixed core at the left side of the depiction being shown in its contracted position, while that at the right side of the structure being shown in its expanded condition.
FIG. 2 is a partial end view of the apparatus shown in FIG. 1 as viewed from the right side thereof.

The present invention is directed to spindle apparatus and particularly a reel receiving mandrel therefor which is used for mounting a reel for the winding onto or winding off of the reel of a web of material. Such web of material, for example, could be a thermoplastic film, paper or the like. In the depicted and to be described embodiment of the present invention, the apparatus is intended for commercial utilization in a cigarette manufacturing operation and in particular in conjunction with the winding and unwinding of cigarette tipping paper onto or off of a bobbin or reel. In such operation, the tipping paper is, for example, subjected to a perforation operation wherein holes are formed in the paper, the paper feeding from a takeoff reel through the perforating operation and back onto a takeup reel. The thus perforated paper is then delivered to the cigarette manufacturing operation wherein the tipping paper is cut into individual cigarette tipping paper lengths and wrapped around the cigarette manufactured in the cigarette making machine.

Referring now to FIGS. 1 and 2 of the drawing, the apparatus 10 includes two spindle units 12, 14 intended for either wind or unwind operations and it will be understood and used in conjunction with a like pair of spindles mounted on an identical apparatus (not shown) arrangement adjacent that shown to allow for the complete wind or unwind operation. In the noted use, two paper perforating units would be employed adjacent the apparatus shown one at each side of the wall enclosure unit 16.

With particular reference to FIG. 1, the apparatus includes as part of wall enclosure unit 12, a pair of supporting walls 18 and 20 intermediate which is mounted for support from the walls as at 22, a pair of actuating cylinder units 24, 26 which have their respective pistons 28, 30 connected to pivot arms 32, 34 which pivot arms in turn are connected to shafts 36, 38 fixed for sliding movement in the walls 18, 20. The shafts 36, 38 are in normal environment disposed for movement along horizontal co-directional axes. Adjacent the walls 18, 20 where the respective shafts 36, 38 pass therethrough, there is disposed bearing support units shown generally at 40 which can include suitable lubrication means 42, the bearing support units 40 being secured by means of locking rings 44 at the inner sides of the walls 18, 20.

Mounted on the bearing support units 40 and fixed for rotation on bearings 46 are hub members 48 which have flat face surfaces 50 against which can be received a side face of a reel 52 (shown in phantom lines), the hub members having an internal annular groove 54 provided for the purpose as will be described below.

Carried at the ends of the shafts 36, 38 are wedging core members 60, 62, the external surface of the wedging cores transiting from a cylindrical outer surface as at 64 to a uniformly conically shaped tapering outer surface as at 66. The wedging cores are as shown mounted on bearings 68 so that the same are rotatable about the fixed axis 70 of the shafts 36, 38. The wedging cores 60, 62 are, however, fixed for longitudinal movement with the shafts 36, 38, that is sliding of the shafts in each of two opposite directions will also cause longitudinal sliding of the wedging cores.

The present invention particularly is concerned with improvements in the mandrel 80 mounted in encircling embrace about the tapered surfaces of the wedging cores 60, 62, the mandrel serving to provide the structure on which the reels 52 are received.

The mandrel 80 is a hollow cylindrical sleeve having an external flange 82 at one end thereof which it will be noted is received in the annular grooves 54 of the hubs 48 so that sliding movement of the shafts and hence the wedging cores while causing expansion of the mandrels will not effect any longitudinal displacement thereof relative to the shafts. Thus, there is ensured that the winding and unwinding operations will always proceed with the intended superposed windings arrangement of the web material on the bobbin or reel. The mandrel sleeve is further characterized by the presence therein of a plurality of axially directed slits 84 which extend circumferentially uniformly spacedly around the sleeve with adjacent ones of the slits extending from opposite tip ends of the sleeve in the direction of the other sleeve and terminating closely adjacent to but spaced from the said other sleeve end. The slits 84 intervene a like plurality of ribs 86 formed in the sleeve so that each rib has connecting structure at one end thereof which is integral with the succeeding next adjacent rib in the plurality and connecting structure at the other end which is integral with the preceding next adjacent rib in the plurality. There is thus provided an alternating arrangement of connecting structure segments at the opposite ends of the sleeve.

In a preferred form, each slit in the sleeve extends from one tip end thereof in the direction of the other tip end of the sleeve for a distance of substantially 95% of the length of the sleeve. In consequence of the pattern of an arrangement of slit and rib formations in the sleeve, the same is susceptible to bending circumferentially on the wedging core and thus can be expanded radially to a reasonable degree for effecting tight engagement of the mandrel outer surface with a reel 52 received thereon. The spindle unit shown at the left side of FIG. 1 depicts a reel member received on the mandrel when the latter is in contracted position. Thus, the reel is loosely positioned on the mandrel. However, the expansion of the sleeve as depicted at the right side spindle unit in FIG. 1 causes tight engagement of the outer surface of the mandrel with the inner surface of the reel.

For effecting expansion of the mandrel, the wedging cores are slid in appropriate direction producing a wedging effect against the inner surface of the sleeve to thereby expand same. For such reason, the internal surface of the sleeve tapers in complemental configuration with the wedging core with the taper as will be noted in the drawing tapering inwardly towards the sleeve axis in the direction of the flange carrying end of the sleeve.

It will thus be seen that the object set forth above among those made apparent from the foregoing description are efficiently attained, since certain changes in the construction set forth which embodies the invention may be made without departing from its scope, it is intended that all matter contained in the above description shall be interpreted as illustrative and not in a limiting sense.

What is claimed is:

1. In spindle apparatus for mounting a reel for winding and unwinding of web material on and off said reel, said apparatus including a shaft slidable along a fixed axis, a wedging core fixed to said shaft and concentric with said fixed axis, and an expandable-contractable mandrel encircling said wedge core and on which said reel is received, sliding of said shaft in one direction effecting movement of said wedging core into contact with said mandrel for expanding same against said reel, sliding of said shaft in an opposite direction effecting movement of said wedging core out of contact with said mandrel for allowing same to contract, the improvement wherein said mandrel comprises a hollow cylindrical sleeve having an external flange at one end, the sleeve being further characterized by the presence of a plurality of axially directed slits therein extending circumferentially uniformly spaced around the sleeve, adjacent ones of said slits extending from opposite tip ends of said sleeve in the direction of the other sleeve end and terminating closely adjacent to but spaced from the said other sleeve end, the slits intervening a like plurality of ribs in said sleeve, each rib having connecting structure at one end thereof integral with the succeeding next adjacent rib in said plurality and connecting structure at the other end thereof integral with the preceding next adjacent rib in said plurality.

2. The apparatus of claim 1 in which each slit in said sleeve extends from one tip end thereof in the direction of the other tip end for a distance substantially 95% of the length of said sleeve.

3. The apparatus of claim 1 in which the internal surface of said sleeve is of tapered configuration, the external surface of said wedging core being complementally configured therewith.

4. The apparatus of claim 3 in which the internal surface of said sleeve tapers inwardly toward the sleeve axis in the direction of the flange carrying end of said sleeve.

5. The apparatus of claim 1 further comprising a hub rotatably mounted on said shaft, the flange on said mandrel being received in an annular groove in said hub to prevent axial movement of said sleeve relative to said shaft.

* * * * *